US006281482B1

(12) United States Patent
Chu

(10) Patent No.: US 6,281,482 B1
(45) Date of Patent: Aug. 28, 2001

(54) ELECTRICAL SWITCH

(75) Inventor: Raymond Wai Hang Chu, Hong Kong (HK)

(73) Assignee: Defond Manufacturing Limited, Chai Wan (HK)

( * ) Notice: Subject to any disclaimer, the term of this patent is extended or adjusted under 35 U.S.C. 154(b) by 0 days.

(21) Appl. No.: 09/615,319

(22) Filed: Jul. 13, 2000

(51) Int. Cl.[7] ..... H05B 3/02

(52) U.S. Cl. ..... 219/507; 200/302.1; 200/533; 200/534; 200/542

(58) Field of Search ..... 219/507, 480; 392/365, 366, 367, 380, 381, 383, 384, 385; 200/293.1, 302.1, 520, 533, 534, 535, 537, 542, 568, 569, 573, 574, 1 R, 5 R, 5 A, 6 R, 6 B, 6 BA, 6 BB, 6 C, 16 R, 16 A, 16 B, 16 C, 16 D, 16 E, 16 F, 341, 342, 518

(56) References Cited

U.S. PATENT DOCUMENTS 4,003,388 * 1/1977 Nopanen ..... 392/384
4,327,278 * 4/1982 Tomaro ..... 392/385
4,711,988 * 12/1987 Thaler et al. ..... 392/385
4,742,199 * 5/1988 Andis et al. ..... 200/302.1
4,839,483 * 6/1989 Doyle ..... 200/302.1
4,879,443 * 11/1989 Carlucci et al. ..... 200/293.1
4,972,065 * 11/1990 Ohlsen ..... 392/380
4,977,306 * 12/1990 Kosaka et al. ..... 392/380
5,394,620 * 3/1995 Chimera ..... 392/384
5,434,946 * 7/1995 Barzilai et al. ..... 392/385
5,507,103 * 4/1996 Merritt ..... 392/384
5,555,637 * 9/1996 Montagnino ..... 392/385
5,612,849 * 3/1997 Prehodka et al. ..... 392/385
5,875,562 * 3/1999 Fogarty ..... 392/385
5,884,008 * 3/1999 Goldberg ..... 392/385
6,011,903 * 1/2000 Nosenchuck ..... 392/385

* cited by examiner

*Primary Examiner*—Teresa Walberg
*Assistant Examiner*—Fadi H. Dahbour
(74) *Attorney, Agent, or Firm*—Leydig, Voit & Mayer, Ltd.

(57) ABSTRACT

An electrical switch including a body, fixed and movable contacts in the body, a principal switching member supported by the body for movement between ON and OFF positions, and a subsidiary switching member supported by the principal switching member for movement in directions different from directions of movement of the principal switching member. The principal switching member has an inner part providing a switching profile to operate the movable contacts with respect to the fixed contacts for switching. The subsidiary switching member has an inner part positioned at the switching profile for changing the switching profile while the principal switching member is in the ON position. The switch may be used to control the operation of a hair dryer to provide, in particular, a COOL shot by operation of the subsidiary switching member.

20 Claims, 3 Drawing Sheets

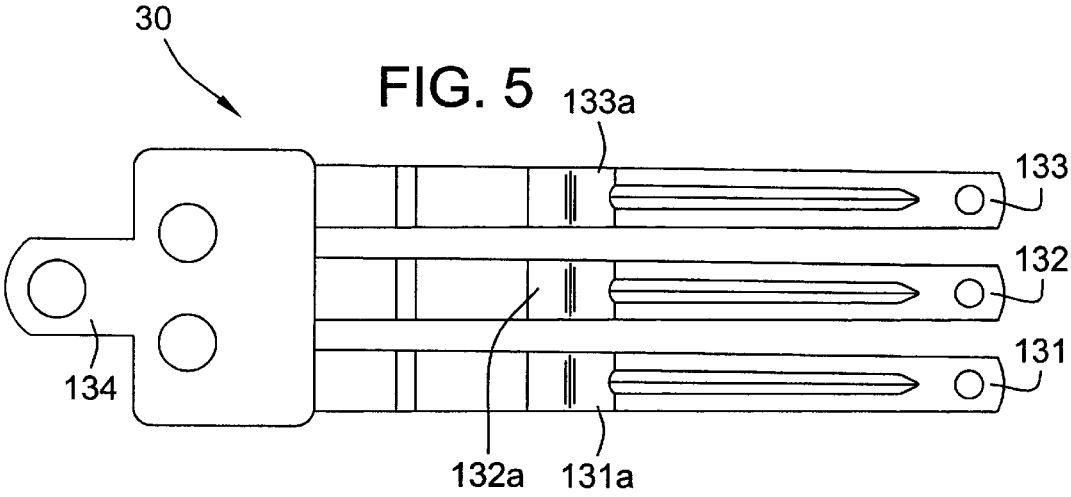
FIG. 5
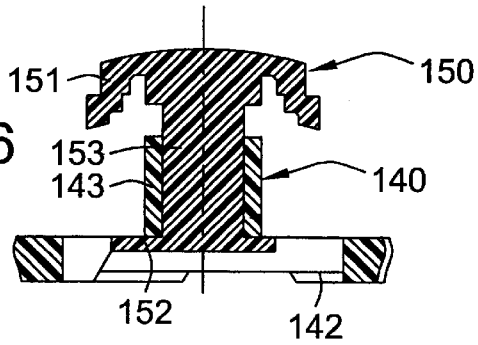
FIG. 6
FIG. 7
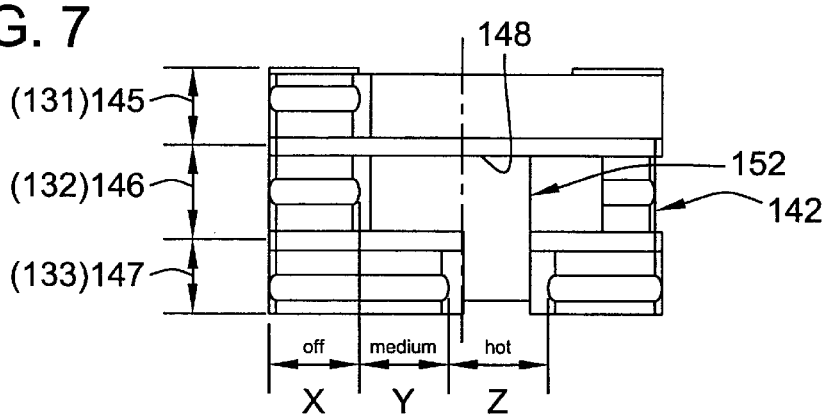
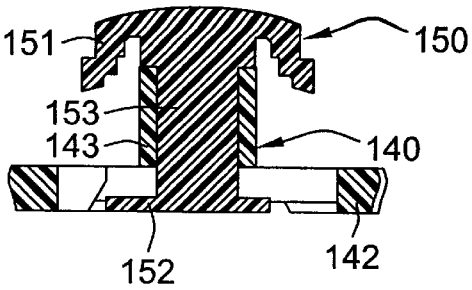
FIG. 8

ELECTRICAL SWITCH

The present invention relates to a switch for controlling the operation of an electrical appliance.

BACKGROUND OF THE INVENTION

Electrical appliances often require the use of more than one switch for control. For example, in the case of a hair dryer, a second switch, usually a push-button switch, is used to enable the hair dryer to provide a COOL shot.

The invention seeks to provide an improved electrical switch that may replace two separate switches.

SUMMARY OF THE INVENTION

According to the invention, there is provided an electrical switch comprising a body, fixed and movable contacts provided in the body, a principal switching member supported by the body for movement in opposite directions between first and second positions, the member having an inner part providing a switching profile to operate the movable contacts with respect to the fixed contacts for switching, and a subsidiary switching member supported by the principal switching member for movement in opposite directions different from the directions of movement of the principal switching member, the subsidiary switching member having an inner part which is positioned at the switching profile for changing the switching profile while the principal switching member is in the first position.

Preferably, the principal and subsidiary switching members are supported for movement in directions substantially perpendicular to each other.

More preferably, the principal switching member is supported for sliding movement and the subsidiary switching member is supported for depression.

In a preferred embodiment, the inner part of the principal switching member is formed with a recess in the switching profile, in which recess the inner part of the subsidiary switching member is positioned.

More preferably, the inner parts are substantially planar and extend substantially parallel to each other.

It is preferred that the switching profile has protruding regions for moving the movable contacts and non-protruding regions to allow return of the movable contacts by resilience, and the recess is formed over at least one non-protruding region such that the inner part of the subsidiary switching member is movable outwards to change the region into a protruding region.

It is preferred that the switching profile has co-parallel tracks for operating the movable contacts respectively, each track comprising a protruding section for moving the corresponding movable contact and a non-protruding section to allow return of the movable contact by resilience.

Preferably, each movable contact is formed with a bend for operation by the switching profile.

It is preferred that the first and second positions are ON and OFF positions respectively.

In a specific construction, the electrical switch comprises three pairs of fixed and movable contacts which are arranged to control the operation of a motor and two heating elements, respectively, of a hair dryer.

BRIEF DESCRIPTION OF DRAWINGS

The invention will now be more particularly described, by way of example only, with reference to the accompanying drawings, in which:

FIG. 5 is a top plan view of a movable contact of the switch of FIG. 1, which is to be operated by the two switching members;

FIG. 6 is a cross-sectional side view of the two switching members of FIG. 1, which are in the position as shown in FIG. 2;

FIG. 7 is a bottom plan view of the two switching members of FIG. 6; and FIG. 8 is a cross-sectional side view of the two switching members of FIG. 6, which are in the position as shown in FIG. 3.

DETAILED DESCRIPTION OF PREFERRED EMBODIMENT

Figure 1:
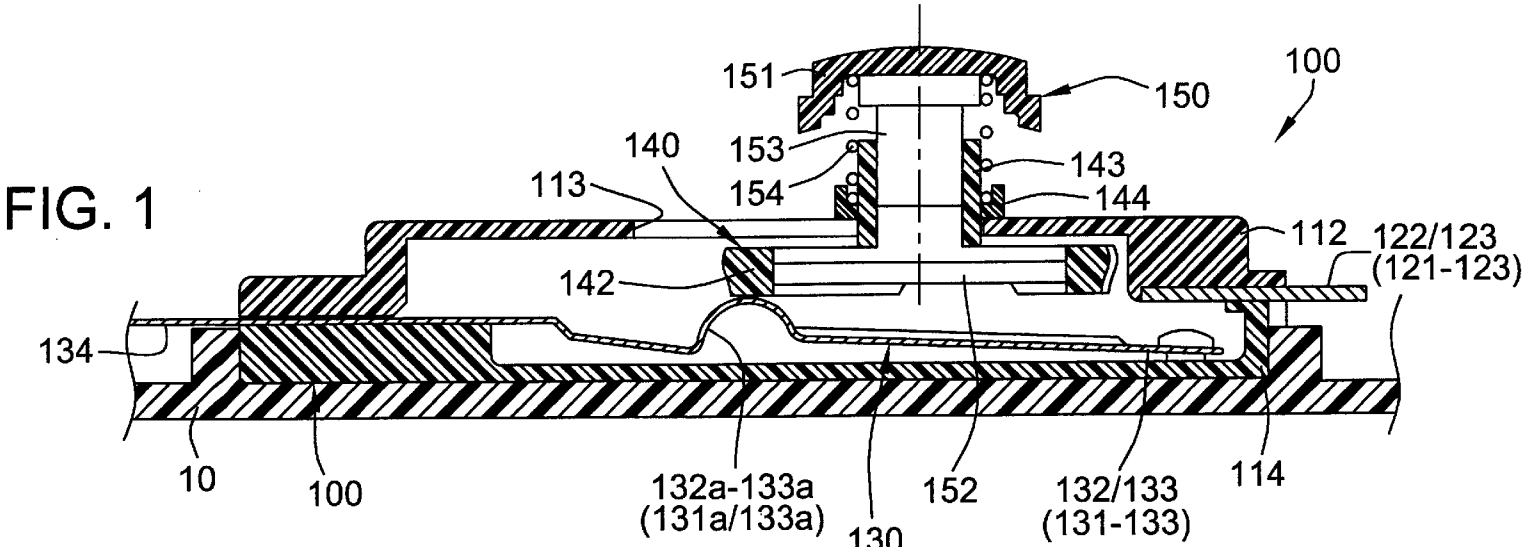
FIG. 1 is a cross-sectional side view of an embodiment of an electrical switch in accordance with the invention for use in a hair dryer, the switch having a principal switching member, which, in turn, incorporates a subsidiary switching member, shown in an OFF position.

Referring to the drawings, there is shown an electrical switch, in the form of a slide switch 100, embodying the invention. The switch 100 has a elongate body 110 including upper and lower part 112 and 114 and includes a series of three fixed contacts 121, 122, and 123 and a movable contact 130. The switch 100 includes a principal switching member 140 that, in turn, incorporates a built-in subsidiary switching member 150, together forming a single switching unit for operating the movable contact 130.

The particular, but not exclusive, use of the switch 100 is to control the operation of a hair dryer 10 which has an electric motor M (for driving a fan) and two electrical heating elements H1 and H2 (for heating air). The hair dryer 10 has an OFF mode and two ON modes, namely a MEDIUM mode in which the motor M and only one heating element H1 are energised and a HOT mode in which the motor M and both heating elements H1 and H2 are used. While operating in either ON mode, the hair dryer 10 is momentarily switchable to provide a COOL shot (cool air blow), by turning off the heating element(s) H1/H2.

The fixed contacts 121, 122, and 123 are located at the right end of the upper body part 112, and are, in use, connected to the motor M and heating elements H1 and H2, respectively. The movable contact 130 extends from the left to the right end of and within the switch body 110, and is fixed at its left end 134 for pivoting up-and-down. The fixed end 134 is, in use, connected to the mains power source.

The right end of the movable contact 130 is trifurcated into a series of three co-extensive contact prongs 131, 132, and 133 which are biassed, by virtue of their resilience, upwards into normally-closed contact with the respective fixed contacts 121, 122, and 123. The prongs 131, 132, and 133 have, at about mid-length, respective inverted U-shaped bends, 132A, 132A and 133A.

The principal switching member 140 has a body including a horizontal base plate 142 and a bushing 143 upstanding therefrom. The bushing 143 passes upwards through a slot 113 of the upper switch body part 112. A collar 144 is snug-fitted around the bushing 143 immediately above the body part 112 for holding the overall switching member 140 in place. The switching member 140 is slidable horizontally in opposite directions along the slot 113, with its base plate 142 lying against the under surface of the body part 112.

The subsidiary switching member 150 has a body including a top cap 151, a horizontal L-shaped base plate 152, and a vertical shaft 153 connecting them. The shaft 153 is disposed slidably through the bushing 143 such that the overall subsidiary switching member 150 is movable up-and-down relative to the principal switching member 140. A coil spring 154 is disposed around the bushing 143, which co-acts between the cap 151 and the collar 144 for resiliently biassing the subsidiary switching member 150 upwards.

The switch 100 includes a top cover which provides a knob 160 for sliding the principal switching member 140 and which includes a hole 162 exposing the cap 151 to permit depression of the subsidiary switching member 150 by the cap 151. A spring-loaded ball 164 is provided on the upper switch body part 112 and three recesses 166 are located on the underside of the knob 160 for successive engagement by the ball 164 to define three switching positions for the knob 160 and, in turn, the principal switching member 140. Such switching positions, when taken from right to left, correspond to the OFF, MEDIUM, and HOT modes of the hair dryer 10.

The principal base plate 142 provides, on its bottom surface, a switching profile of three co-parallel tracks 145, 146, and 147 for operating the respective prongs 131, 132, and 133A of the movable contact 130 by their bends 131A, 132A, and 133A. A series of three sections X/Y/Z is defined along the tracks 145, 146, and 147, which, when taken from left to right, correspond to the OFF, MEDIUM, and HOT modes of the hair dryer 10. Each of the first and second tracks 145 and 146 protrudes downwardly over the section X but is flat (non-protruding) over the other two sections Y and Z. The third track 147 protrudes over both sections X and Y, but is flat over the remaining section Z.

The principal base plate 142 includes an L-shaped recess 148 over the flat track sections 146Y, 146Z, and 147Z, which matches with and receives the subsidiary base plate 152. These track sections 146Y, 146Z, and 147Z remain flat while the subsidiary base plate 152 stays wholly within the recess 148, but become downwardly protruding when the subsidiary switching member 150 is depressed so its base plate 152 is moved out of the recess 148.

Figure 2:
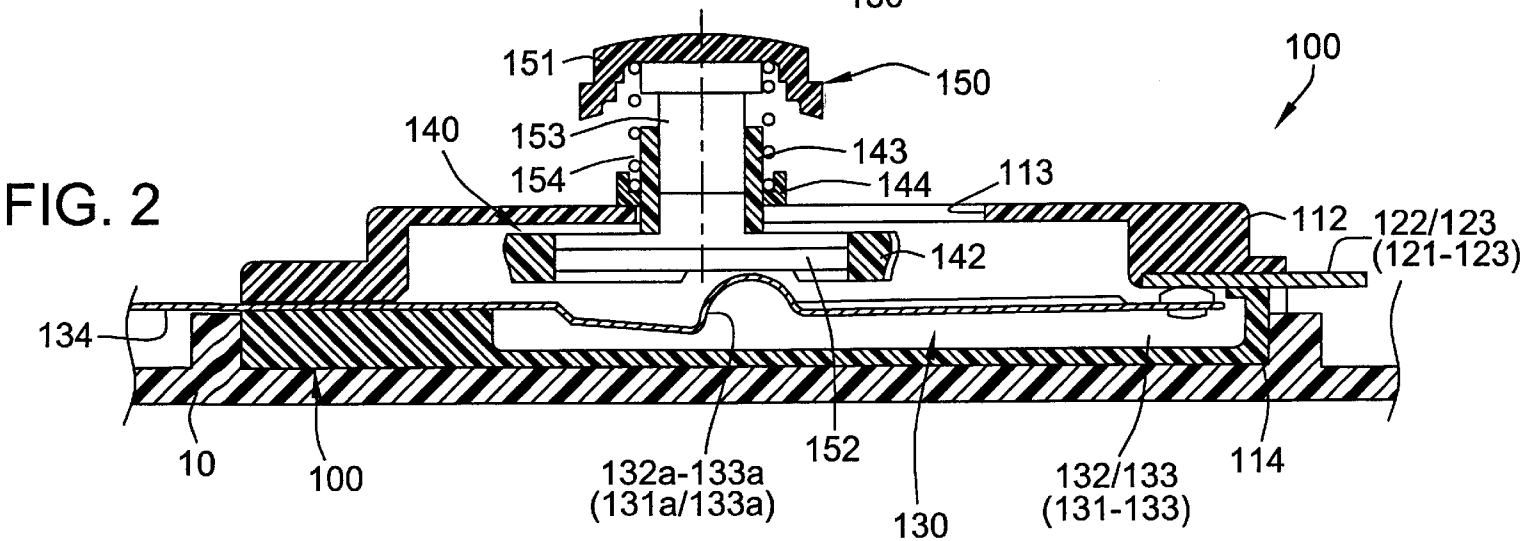
FIG. 2 is a cross-sectional side view of the switch of FIG. 1, showing the principal switching member in a HOT position.

In operation, sliding of the principal switching member 140 from the right, past the middle, to the left switching position will cause alignment of its base plate track sections X/Y/Z successively with the contact prong bends 131A, 132A and 133A. In the right switching position (FIG. 1), the protruding track sections 145A, 146X and 147X push all three contact prongs 131, 132, and 133 downwards, away from the corresponding fixed contacts 121, 122, and 123, whereby the hair dryer 10 is in the OFF mode. In the left switching position (FIG. 2), the flat track sections 145Z, 146A, and allow all three contact prongs 131, 132, and 133 to return contact with the corresponding fixed contacts 121, 122, and 123, whereby the hair dryer 10 is switched into the HOT mode. In the middle switching position (not shown), only the track section 147Y pushes its associated contact prong 133 downwards, with the other two track sections 145Y and 146Y being flat so their associated contact prongs 131 and 132 contact the corresponding fixed contacts 121 and 122, whereby the hair dryer 10 is switched into the MEDIUM mode.

Figure 3:
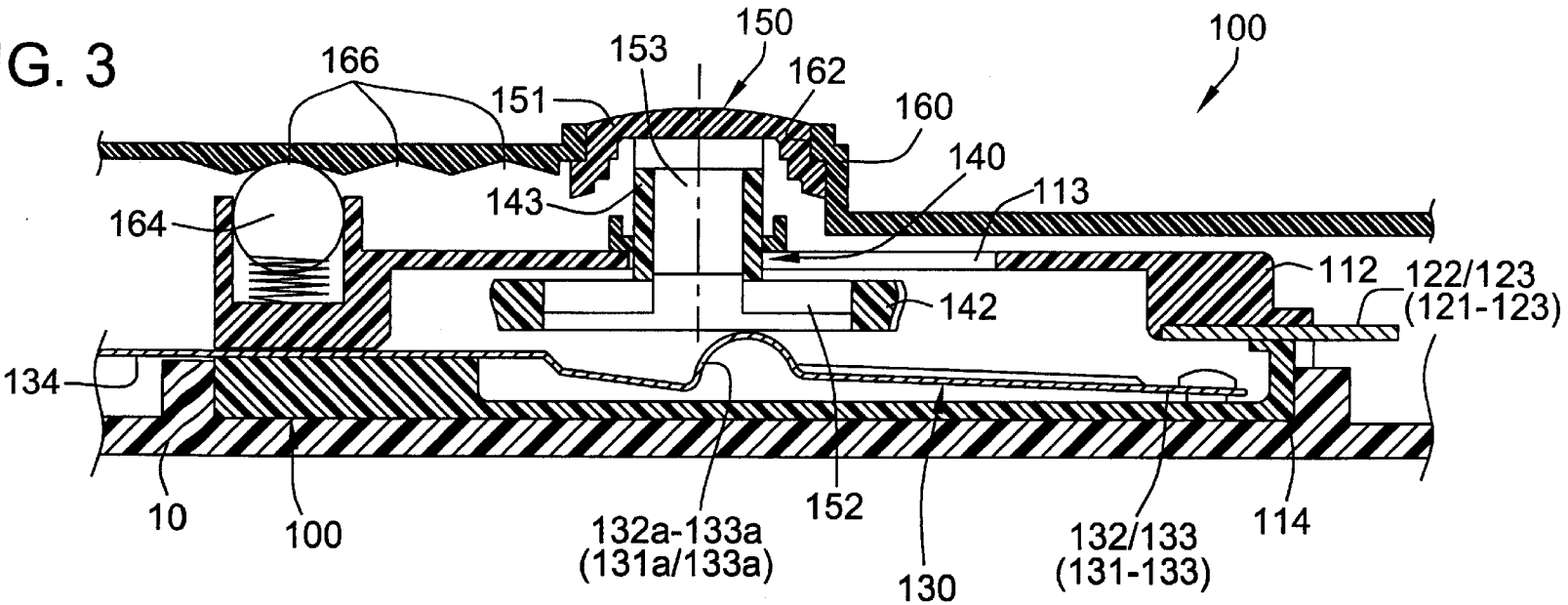
FIG. 3 is a cross-sectional side view of the switch of FIG. 2, showing the subsidiary switching member depressed to provide a COOL shot.
Figure 4:
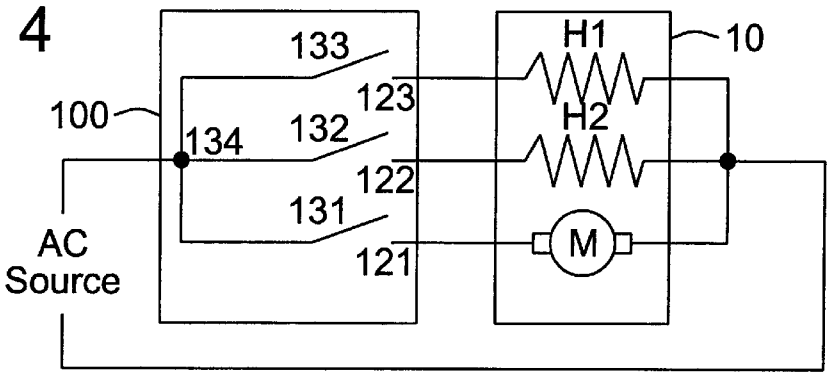
FIG. 4 is a circuit diagram of the switch of FIG. 1 connected to the hair dryer.

While the principal switching member 140 is in the left switching position (FIG. 2), momentary depression of the subsidiary switching member 150 will cause its base plate 152 to move downwards over the track sections 146Z and 147Z, insofar as the track section Z is concerned. This results in the track sections 146Z and 147Z protruding or, in effect to change into protruding sections, thereby pushing the associated contact prongs 132 and 133 downwards, away from the corresponding fixed contacts 122 and 123 (FIG. 3). Both heating elements H1 and H2 are thus turned off to enable the hair dryer 10 to provide a COOL shot in the HOT mode, for as long as the subsidiary switching member 150 remains depressed.

A similar COOL shot is possible while the hair dryer is operating in the MEDIUM mode, by momentarily depressing the subsidiary switching member 150. In this case, the concerned track section 146Y will in effect to, push the associated contact prong 132 downwards, away from the corresponding fixed contact 122, thereby turning off the heating element H1.

Accordingly, the switching profile provided by the principal switching member 140 may be changed or altered by the subsidiary switching member 150 by means of its base plate 152.

It is envisaged that the principal switching member may be made rotatable or pivotable, instead of being slidable, as described, for operation.

The invention has been given by way of example only, and various other modifications of and/or alterations to the described embodiment may be made by persons skilled in the art without departing from the scope of the invention as specified in the appended claims.

What is claimed is:

1. An electrical switch comprising:

a body;

first and second fixed contacts fixedly mounted on the body;

first and second movable contacts located within the body and movable into and out of contract with the first and second fixed contacts, respectively;

a principal switching member moving between first and second positions and actuating the first and second movable contacts, bringing the first fixed contact and the first movable contact into contact and the second fixed contact and the second movable contact into contact in the second position of the principal switching member, the first and second fixed and movable contacts being separated from each other when the principal switching member is in the first position; and a subsidiary switching member supported and moving with the principal switching member between the first and second positions of the principal switching member, the subsidiary switching member moving between third and fourth positions independent of the principal switching member, the subsidiary switching member separating the second movable contact from the second fixed contact when the principal switching member is in the second position and the subsidiary switching member is in the fourth position.

2. The electrical switch as claimed in claim 1 wherein the subsidiary switching member does not alter contact between the first fixed contact and the first movable contact and between the second fixed contact and the second movable contact when the principal switching member is in the first position.

3. The electrical switch as claimed in claim 1 wherein the subsidiary switching member does not alter contact between the first fixed contact and the first movable contact and between the second fixed contact and the second movable contact when the subsidiary switching member is in the third position.

4. The electrical switch as claimed in claim 1 wherein the principal switching member moves between the first and second positions along a first direction and the subsidiary switching member moves between the third and fourth positions along a second direction, transverse to the first direction.

5. The electrical switch as claimed in claim 1 wherein the principal switching member slides between the first and second positions and is stable in the first and second positions and the subsidiary switching member is resiliently biased toward the fourth position.

6. The electrical switch as claimed in claim 1 wherein the principal switching member is part of a slide switch and the subsidiary switching member is part of a push button switch.

7. The electrical switch as claimed in claim 1 wherein the first and second movable contacts respectively include first and second resilient contact prongs, the principal switching member includes an inner part having a recess, and the subsidiary switching member includes an inner part having a surface for bearing on the second resilient contact prong, the inner part of the subsidiary switching member being slidably received in the recess for movement out of the recess to deflect the second resilient contact prong, thereby separating the second movable contact from the second fixed contact.

8. The electrical switch as claimed in claim 7 wherein the inner part of the principal switching member includes a surface bearing on the first resilient contact prong and including a second recess for receiving part of the first resilient contact prong to bring the first movable contact into contact with the first fixed contact.

9. The electrical switch as claimed in claim 8 wherein the surface of the inner part of the principal switching member for bearing on the first resilient contact prong and the surface of the inner part of the subsidiary switching member for bearing on the second resilient contact prong include parallel tracks for bearing on the respective resilient contact prongs and including respective protruding portions for separating the first fixed contact and the first movable contact from each other and the second fixed contact and the second movable contact from each other, respectively.

10. The electrical switch as claimed in claim 9 wherein each of the first and second resilient contact prongs includes an arcuate portion for contact with one of the tracks.

11. The electrical switch as claimed in claim 1 including a third fixed contact fixedly mounted to the body and a third movable contact located within the body and movable into and out of contact with the third fixed contact, wherein the principal switching member moves between the second position and a fifth position, actuating the third movable contact and bringing the third fixed contact and the third movable contact into contact in the fifth position of the principal switching member, and the subsidiary switching member separates the third fixed contact from the third movable contact when the principal switching member is in the fifth position and the subsidiary switching member is in the fourth position.

12. The electrical switch as claimed in claim 11 wherein the subsidiary switching member does not alter contact between the third fixed contact and the third movable contact when the principal switching member is in the first and second positions.

13. The electrical switch as claimed in claim 11 wherein the subsidiary switching member does not alter contact between the third fixed contact and the third movable contact when the principal switching member is in the first and second positions.

14. The electrical switch as claimed in claim 11 wherein the principal switching member moves between the first, second, and fifth positions along a first direction and the subsidiary switching member moves between the third and fourth positions along a second direction, transverse to the first direction.

15. The electrical switch as claimed in claim 11 wherein the principal switching member slides between the first, second, and fifth positions and is stable in each of the first, second, and fifth positions and the subsidiary switching member is resiliently biased toward the fourth position.

16. The electrical switch as claimed in claim 15 wherein the principal switching member is part of a slide switch and the subsidiary switching member is part of a push button switch.

17. The electrical switch as claimed in claim 11 wherein the first, second, and third movable contacts respectively include first, second, and third resilient contact prongs, the principal switching member includes an inner part having a recess, and the subsidiary switching member includes an inner part having a surface for bearing on the second and third resilient contact prongs, the inner part of the subsidiary switching member being slidably received in the recess for movement out of the recess to deflect the second and third resilient contact prongs, thereby separating the second and third movable contacts from the second and third fixed contacts, respectively.

18. The electrical switch as claimed in claim 17 wherein the inner part of the principal switching member includes a surface bearing on the first resilient contact prong and including a second recess for receiving part of the first resilient contact prong to bring the first movable contact into contact with the first fixed contact.

19. The electrical switch as claimed in claim 18 wherein the surface of the inner part of the principal switching member for bearing on the first resilient contact prong and the surface of the inner part of the subsidiary switching member for bearing on the second and third resilient contact prongs include parallel tracks for bearing on the respective resilient contact prongs and including respective protruding portions for separating the first fixed contact and the first movable contact from each other, the second fixed contact and the second movable contact from each other, and the third fixed contact and the third movable contact from each other, respectively.

20. The electrical switch as claimed in claim 19 wherein each of the first, second, and third resilient contact prongs includes an arcuate portion for contact with one of the tracks.

* * * * *